US006709065B2

(12) United States Patent
Peay et al.

(10) Patent No.: US 6,709,065 B2
(45) Date of Patent: Mar. 23, 2004

(54) ROTARY CUTTING BIT WITH MATERIAL-DEFLECTING LEDGE

(75) Inventors: Kent Peay, Bristol, TN (US); Timothy J. Shean, Bristol, TN (US)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 10/058,387

(22) Filed: Jan. 30, 2002

(65) Prior Publication Data

US 2003/0141753 A1 Jul. 31, 2003

(51) Int. Cl.[7] ..... E21C 25/10
(52) U.S. Cl. ..... 299/104; 299/111
(58) Field of Search ..... 299/110, 111, 299/104, 105, 106

(56) References Cited

U.S. PATENT DOCUMENTS

| | | | | | |
|---|---|---|---|---|---|
| 3,746,396 | A | * | 7/1973 | Radd | 299/10 |
| 3,945,681 | A | | 3/1976 | White | |
| 4,489,986 | A | * | 12/1984 | Dziak | 299/104 |
| 4,688,856 | A | * | 8/1987 | Elfgen | 299/104 |
| 4,725,098 | A | | 2/1988 | Beach | |
| 5,417,475 | A | * | 5/1995 | Graham et al. | 299/105 |
| 5,823,632 | A | | 10/1998 | Burkett | |
| 6,113,195 | A | | 9/2000 | Mercier et al. | |
| 6,196,636 | B1 | | 3/2001 | Mills et al. | |
| 6,382,733 | B1 | * | 5/2002 | Parrott | 299/106 |

FOREIGN PATENT DOCUMENTS

| | | | | | |
|---|---|---|---|---|---|
| DE | 3500261 | A1 | * | 7/1986 | E21C/25/38 |
| DE | 3818213 | A1 | * | 11/1989 | E21C/35/18 |
| GB | 2 004 315 | | | 3/1979 | |
| GB | 2037223 | A | * | 7/1980 | B28D/1/22 |

* cited by examiner

*Primary Examiner*—David Bagnell
*Assistant Examiner*—Daniel P Stephenson
(74) *Attorney, Agent, or Firm*—Burns, Doane, Swecker & Mathis, LLP

(57) ABSTRACT

A cutting bit includes a steel body on which a carbide cutting tip is brazed. Disposed rearwardly of a rearwardmost end of the tip, on a tapered side surface of a head of the bit body is an annular ledge which extends laterally outwardly sufficiently far to deflect cuttings laterally away from the bit. The ledge can be formed integrally with the bit body as the result of a machining operation, or the ledge can comprise a split ring that is elastically held in a groove formed in the tapered side surface. The ledge extends perpendicularly to a center axis of the bit, or is inclined slightly forwardly, in order to trap cuttings, such as asphalt, to cause a protective ring of asphalt to be formed in front of the ledge.

21 Claims, 3 Drawing Sheets

ROTARY CUTTING BIT WITH MATERIAL-DEFLECTING LEDGE

BACKGROUND OF THE INVENTION

The present invention relates to cutting tools used to cut through soft ground or through relatively soft material that has been laid on the ground, such as asphalt roadways.

Mining, excavating, and road resurfacing operations are typically performed by forcing rotary cutting bits through the material being cut. The cutting bits are mounted on a driven support, such as a rotary drum, fixed beam, or the like to be forced through the material. A typical cutting bit disclosed for example in U.S. Pat. No. 6,113,195 and shown as cutting bit 1 in FIG. 1 herein, comprises a hard carbide tip 2 that is brazed to the front surface of a steel shank 3. The shank is to be mounted in a holder (not shown) by means of a retainer sleeve 4 which permits the bit to rotate freely relative to the holder about the bit's center axis, while being restrained against axial dislodgment from the holder. Due to being freely rotatable, the tip is basically self-sharpening.

It should be understood that cutting mechanisms of the type described above have been used to cut through hard materials, such as rock and ice, in addition to cutting through softer materials such as asphalt. During the cutting of rock, the highest rate of bit wear occurs at the carbide tip, so the wear life of the bit is determined by the carbide tip. However, during the cutting of relatively softer material, such as asphalt, the highest rate of wear occurs at the shank, i.e., erosion caused by cut asphalt rubbing and impacting against the shank. Thus, when cutting asphalt during a road resurfacing operation, the wear life of the cutting bit is determined by the shank.

It would be desirable to provide a cutting bit that has an increased wear life when used for cutting softer materials such as asphalt.

Disclosed in U.S. Pat. No. 4,725,098 is a cutting bit in which a groove is machined in a tapering side surface of the bit head closely behind a carbide tip mounted in the bit head. Hardfacing is deposited into the groove to form an erosion-resistant annular ring which can be flush with, or project slightly radially beyond, the side surface. Despite being formed of hard material, the ring will be subjected to considerable erosion by cuttings and thus will have a somewhat limited life.

It would be desirable to provide a cutting bit with an erosion-resistant structure which has an enhanced life.

SUMMARY OF THE INVENTION

The present invention relates to a cutting bit which comprises a body that includes a shank and a head disposed at a front end of the shank. The head includes a forwardly facing front surface, and a tapered side surface having a cross section which increases in a rearward direction. The bit also includes a cutting tip attached to the front surface of the head and formed of a harder material than the body. The head includes a ledge projecting from the tapering side surface in a laterally outward direction relative to a longitudinal axis of the body. The ledge projects from the tapered side surface at a location spaced rearwardly from a rearwardmost end of the tip, and is oriented substantially perpendicularly to the longitudinal axis.

Preferably, the ledge is oriented such that a laterally outer end of the ledge is situated no farther rearwardly than a laterally inner end thereof. Most preferably, the outer end of the ledge is situated slightly forwardly of the inner end of the ledge, e.g., by inclining the ledge slightly forwardly.

The ledge can be formed integrally of one-piece construction with the rest of the bit body, or can comprise a separate split ring which is elastically held on the body.

The ledge preferably has sufficient width to facilitate the adherence thereto of material, such as asphalt, during an asphalt-cutting operation. For example, the ledge could project laterally outwardly by a distance greater than 10%, most preferably greater than 15%, of a radius of the tapered surface as measured at the point of intersection of the tapered surface with the ledge.

BRIEF DESCRIPTION OF THE DRAWINGS

The objects and advantages of the invention will become apparent from the following detailed description of preferred embodiments thereof in connection with the accompanying drawings in which like numerals designate like elements and in which.

DETAILED DESCRIPTION OF PREFERRED EMBODIMENTS OF THE INVENTION

Figure 2:
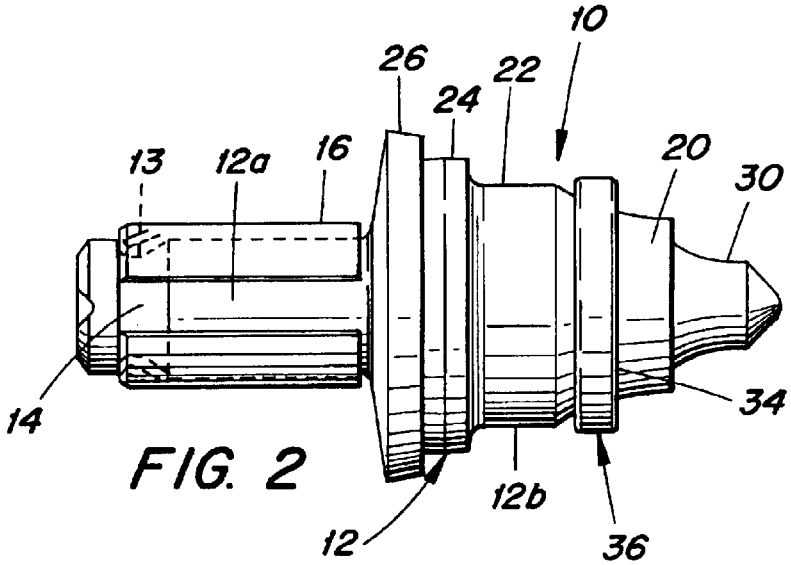
FIG. 2 is a side elevational view of a rotary cutting bit according to a first embodiment of the present invention.
Figure 3:
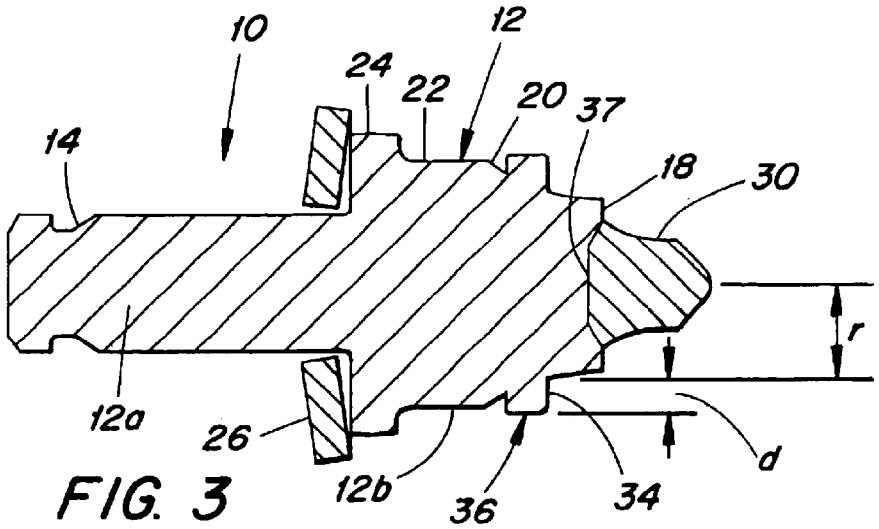
FIG. 3 is a longitudinal sectional view taken through the cutting bit of FIG. 2, with a split retaining sleeve removed from the bit body.
Figure 4:
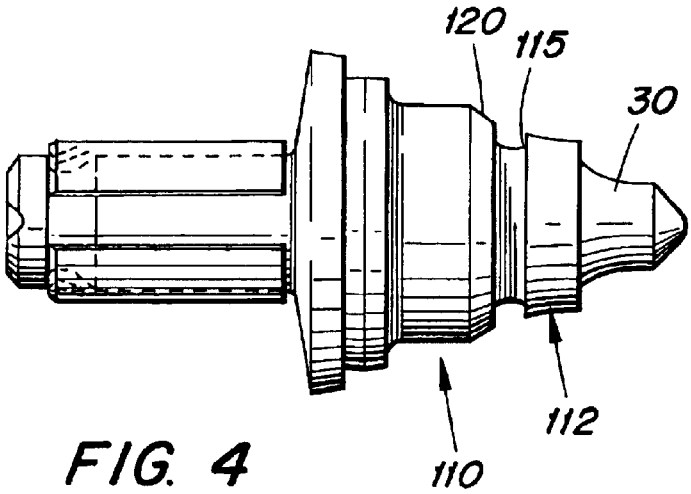
FIG. 4 is a side elevational view of a bit body of a second embodiment of a rotary cutting bit according to the present invention.
Figure 5:
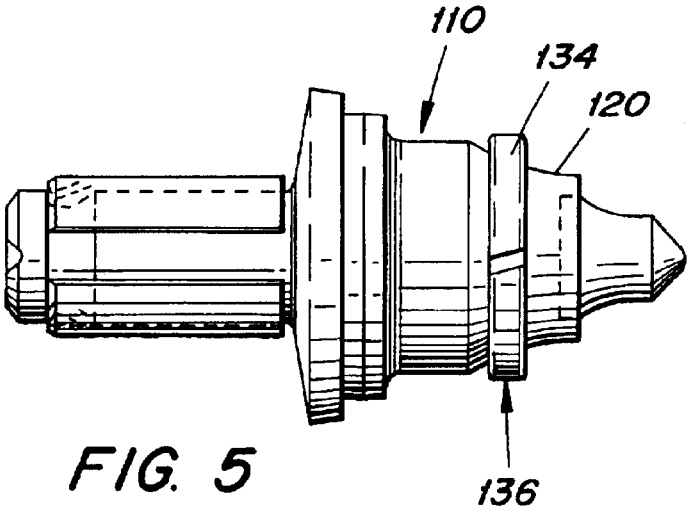
FIG. 5 is a view similar to FIG. 4 after an elastic ring has been mounted on the bit body.
Figure 6:
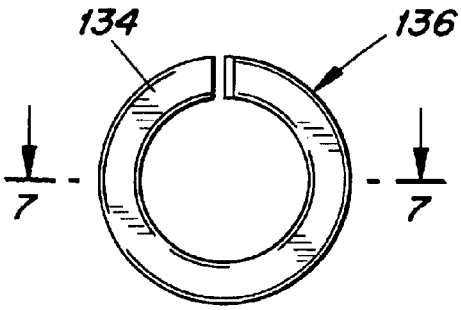
FIG. 6 is a front view of the elastic ring.

Depicted in FIGS. 2 and 3 is a cutting bit 10 according to a first preferred embodiment of the invention which includes a body 12 having a rear shank 12*a* and a front head 12*b*. The shank 12*a* includes a recess 14 in which a bent tab 13 of a split retaining sleeve 16 is mounted. The retaining ring functions to axially retain the bit 10 in the bore of a holder (not shown), while permitting the bit to rotate freely relative to the holder about a longitudinal center axis of the bit, whereby the bit is self-sharpening during a cutting operation. In lieu of a split retaining sleeve, any means of retaining the bit could be used as long as the bit is able to rotate.

The head 12*b* includes a forwardly facing front surface 18, and a tapered side surface portion 20 extending rearwardly from the front surface 18 so as to be of gradually increasing cross section in the rearward direction. A cylindrical side surface portion 22 of the head extends rearwardly from the tapered side surface portion 20 and terminates at a flange 24 of larger diameter than the cylindrical side surface 22. If desired, a washer 26 can be mounted on the shank 12*a* behind the flange 26 before the bit is inserted into a holder.

Figure 9:
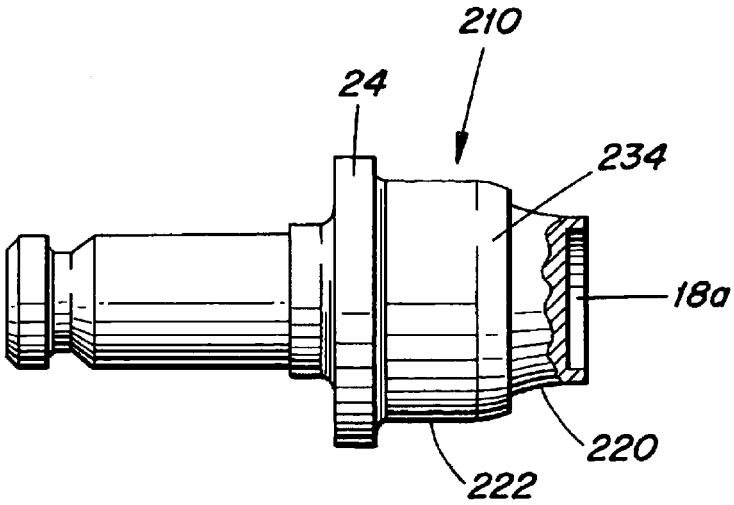
FIG. 9 is a side elevational view of a third preferred embodiment of a bit body according to the present invention, with a front portion thereof broken away to reveal a pocket adapted to receive a hard tip.

A cutting tip 30 is attached to the front surface 18, in any suitable way, such as by brazing a rear protuberance of the tip within a pocket 18*a* formed in the front surface 18 (see the pocket 18*a* in FIG. 9). The largest outer diameter of the tip 30 is less than a smallest diameter of the tapered side surface portion 20, although the largest outer diameter of the tip 30 could instead be equal to, or less than, the smallest diameter of the surface portion 20.

The tip 30 is formed of a harder material than the bit body 12. For instance, the tip can be formed of cemented carbide and the body 12 formed of steel. Typically, the steel bit body is thermally hardened at the same time that the tip 30 is being brazed to the body.

The tapered side surface portion 20 is shown as being of concave shape as viewed in a longitudinal cross section of the bit (FIG. 3), but it need not be concave, e.g., it could be of conical shape.

Figure 1:
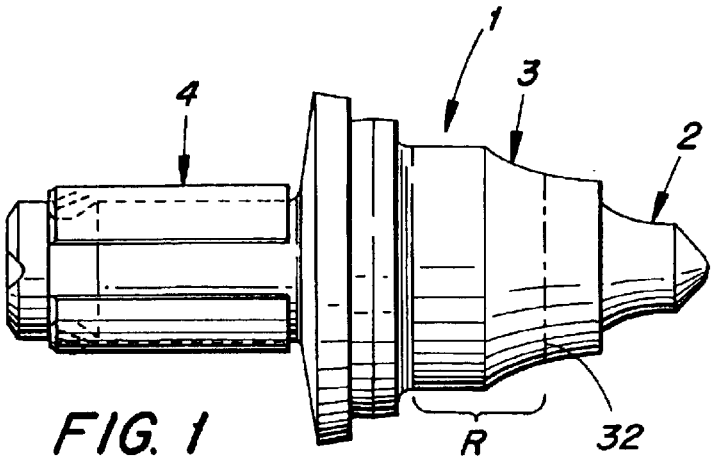
FIG. 1 (PRIOR ART)
FIG. 1 is a side elevational view of a conventional rotary cutting bit.

As indicated earlier, when a bit of the type depicted in FIG. 1 is used to cut relatively soft materials, such as asphalt, the steel bit body 12 erodes at a faster rate than the tip 30. The rapid erosion occurs primarily in a region R of the bit body spaced rearwardly from the front surface 18, i.e., the erosion occurs rearwardly (to the left) of a phantom line 32 shown in FIG. 1, which line is about midway between front and rear ends of the tapered side surface portion 20. The erosion is especially intensive when multiple passes of the bits are made through the asphalt, because previously cut asphalt pieces are flung longitudinally and laterally against the bit body.

Accordingly, in accordance with the present invention, the bit body is provided with a laterally extending, forwardly facing ledge 34 which not only protects the wear-susceptible region R, but also functions to trap a ring of asphalt which serves to minimize wear of the ledge, as will be explained.

In the embodiment according to FIGS. 2 and 3, the ledge 34 is formed during the initial shaping (machining) of the steel bit body by so that the ledge is of integral one-piece construction with the rest of the bit body. Thus, during the machining, an annular ring 36 is formed which projects laterally outwardly from the tapered surface 20, a forwardly facing surface of the ring defining the ledge 34. The ledge projects from the tapered surface 20 at a location spaced rearwardly from a rearwardmost end 37 of the tip 30.

The ledge 34 extends outwardly from the tapered surface 20 in a direction substantially perpendicular to a center axis of the bit in order to be able to trap asphalt. More preferably, it can be stated that a laterally outer end of the ledge is situated no farther rearwardly than the laterally inner end of the ledge. Most preferably, the ledge can be inclined slightly forwardly, as will be described subsequently in connection with another preferred embodiment.

Figure 8:
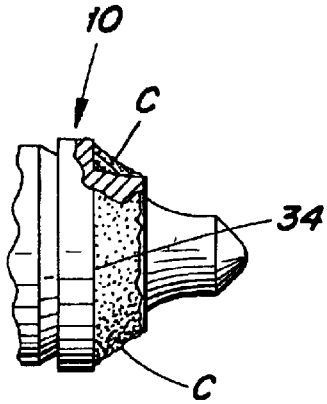
FIG. 8 is a fragmentary view of FIG. 2 showing how asphalt or the like can become trapped in front of the ledge to form anti-wear protective layer for the ledge.

In any event, the ledge extends laterally from its annular line of intersection with the tapered surface preferably by a distance d which defines a width of the ledge. That width d is greater than 10%, and more preferably greater than 15%, of a radius r of the tapered surface 20 as measured at the intersection of the ledge and the tapered surface (see FIG. 3). During operation of the bit 10, not only will the ledge be able to laterally deflect the cuttings, such as asphalt pieces, but some cuttings will be trapped by the ledge to form a ring C of asphalt in front of the ledge, as shown in FIG. 8. Accordingly, when additional cuttings thereafter approach the ledge, they will slide off the asphalt ring C rather than sliding along the ledge itself, so the frictional erosion of the ledge will be minimized. That is important since the ledge in the embodiment of FIGS. 2–3 is not formed of a harder material than the steel bit body.

In operation, multiple bits of the type depicted in FIGS. 2–3 will be rotatably mounted on a support, such as a rotary drum or a fixed beam, and then forced through a material to be cut. For example, when resurfacing an asphalt roadway, bits mounted on a rotary drum will be forced through the asphalt, with the bits cutting partway through the thickness of the asphalt. This is performed in repeated passes, leaving a considerable amount of loose asphalt chunks after each pass. During successive passes, the loose chunks are flung laterally and axially toward the bits, especially toward the region R, as the chunks travel toward a center of the drum to be picked up by a conveyor. Initially, many of those loose chunks will encounter the ledge 34 and be deflected laterally outwardly before reaching the region R. Eventually, some of the asphalt will adhere to the ledge 34 to form the asphalt ring C (FIG. 8), which is beneficial in that subsequently encountered chunks will slide off the adhered (trapped) asphalt, rather than sliding directly along the ledge, and thus avoiding wear of the ledge itself.

Due to the reduced rate of erosion of the bit body resulting from the presence of the ledge 34, the life of the body will more closely approach that of the carbide tip, thereby increasing the overall life of the bit.

In a second preferred embodiment of a bit 110 according to the invention, depicted in FIGS. 4–7, the ledge 134 is not formed integrally of one-piece with the bit body, but rather is formed by the front face of a separate ring 136. The ring 136 is in the form of a split ring that can be radially expanded elastically in order to be slid rearwardly over the front end (nose) of the bit body 112 and then released to snap into an annular groove 115 that is machined into the tapered surface 120. Otherwise, the structure can correspond to that of FIGS. 2–3 in relation to the size and location of the ledge.

Figure 7:
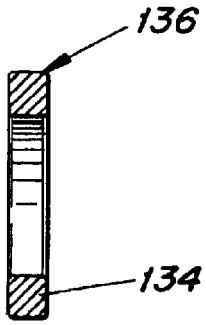
FIG. 7 is a sectional view taken along the line 7—7 in FIG. 6.

The cross sectional shape of the ring 136 is rectangular, as can be seen in FIG. 7, in order to provide a generally flat ledge 134, but if desired other cross sectional shapes such as curved shapes could be provided, not only in the embodiment according to FIGS. 4–7, but also in the embodiment according to FIGS. 2 and 3.

An advantage of the ring 136 according to FIGS. 4–7 over the ring 36 of FIGS. 2–3 is that since the ring 136 is formed separately of the bit body, the ledge 136 can be formed of a harder material than the bit body so as to exhibit enhanced erosion resistance.

A third embodiment of a cutting bit 210 according to the invention is depicted in FIG. 9, wherein the cylindrical surface 222 extends all the way forwardly to the laterally outer end of the ledge 234. Thus, the rearwardmost end of the tapered surface 220 occurs where that surface intersects the ledge 234.

Figure 10:
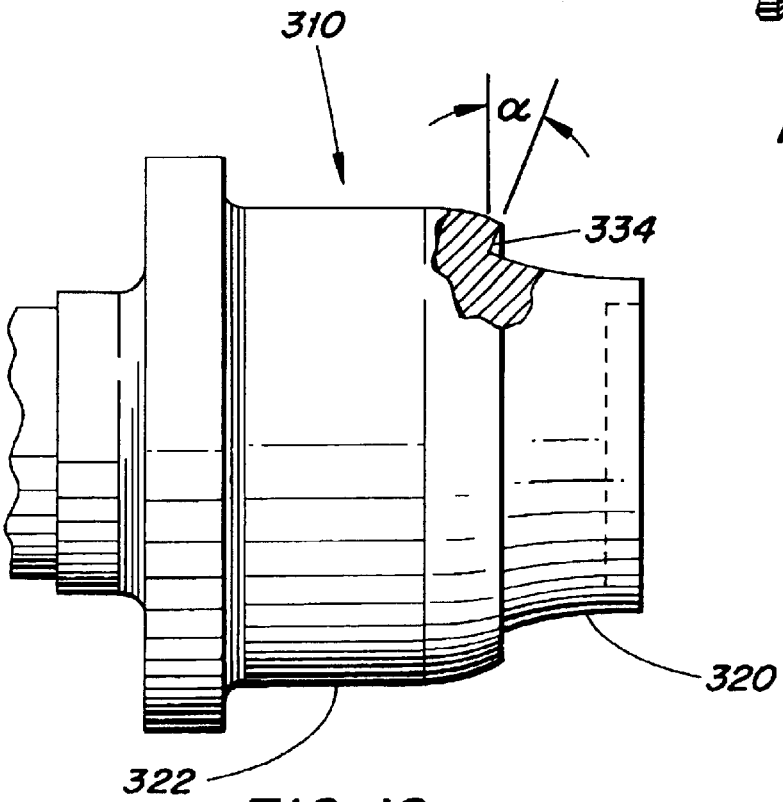
FIG. 10 is a fragmentary side view of a front end of a fourth embodiment of a bit body according to the present invention, with a portion thereof broken away.

A fourth embodiment of a cutting bit 310 is depicted in FIG. 10 which is similar to that of FIG. 9 in that the cylindrical surface 322 extends to the ledge 334, but is different from FIG. 9 in that the ledge is inclined slightly forwardly from the tapered surface, e.g., at an angle $\propto$ no greater than about 10 degrees, such as 8 degrees. The slight forward inclination of the ledge is beneficial in that it facilitates the trapping and retaining of an asphalt ring C.

It will be appreciated from the foregoing that the present invention provides a cutting bit having a relatively wide ledge which is able to not only effectively deflect cuttings laterally outwardly, but also to trap a ring of cuttings which insulates the ledge from wear that would otherwise be caused by additional cuttings sliding across the ledge. Also, the creation of the ledge by the attachment of a ring 136 or a machining-away of part of the bit body is relatively inexpensive as compared for example to a hard facing procedure required to form a ring in U.S. Pat. No. 4,725,098.

Also, even if some of the hard facing of that U.S. Pat. No. 4,725,098 were to project laterally outwardly past the bit body so as to define a ledge, that ledge will likely not be located far enough from the bit or extend sufficiently far from the tapered surface to be able to trap a ring of cuttings as in the present invention.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A cutting bit comprising:

a body including a shank and a head disposed at a front end of the shank, the head including a forwardly facing front surface, and a tapered side surface disposed behind the front surface, the tapered side surface having a cross section which increases in a rearward direction of the head; and a cutting tip attached to the front surface of the head and formed of a harder material than the body, the head including a ledge projecting from the tapered surface in a laterally outward direction relative to a longitudinal axis of the body, wherein the ledge projects from the tapered surface at a location spaced rearwardly from a rearwardmost end of the tip and is oriented substantially perpendicularly to the longitudinal axis.

2. The cutting bit according to claim 1 wherein the ledge projects laterally outwardly from the tapered surface by a distance greater than 10% of a radius of the tapered surface as measured at an intersection of the ledge with the tapered surface.

3. The cutting bit according to claim 2 wherein the distance is greater than 15% of the radius.

4. The cutting bit according to claim 1 wherein the tapered surface is of concave configuration.

5. The cutting bit according to claim 1 wherein the ledge is defined by a split ring mounted elastically in an annular groove machined in the tapered side surface, the ledge defined by a forwardly facing surface of the ring.

6. The cutting bit according to claim 5 wherein the ring is of generally rectangular cross sectional shape.

7. The cutting bit according to claim 5 wherein the ring is formed of a harder material than the bit body.

8. The cutting bit according to claim 1 wherein the head is machined to form the ledge, wherein the ledge is of integral one-piece construction with the head.

9. The cutting bit according to claim 1 wherein the ledge is disposed intermediate front and rear ends of the tapered surface.

10. The cutting bit according to claim 1 wherein the ledge is located at a rear end of the tapered surface.

11. The cutting bit according to claim 1 wherein the ledge is defined by a separate ring mounted on the tapered surface.

12. A cutting bit comprising:

a body including a shank and a head disposed at a front end of the shank, the head including a forwardly facing front surface, and a tapered side surface disposed behind the front surface, the tapered side surface having a cross section which increases in a rearward direction of the head; and a cutting tip attached to the front surface of the head and formed of a harder material than the body, the head including a ledge projecting in a laterally outward direction relative to a longitudinal axis of the body, wherein the ledge projects from the tapered surface at a location spaced rearwardly from a rearwardmost end of the tip, a laterally outer end of the ledge being disposed no farther rearwardly than a laterally inner end of the ledge.

13. The cutting bit according to claim 12 wherein the ledge is inclined forwardly from the tapered surface.

14. The cutting bit according to claim 13 wherein an angle of inclination of the ledge is no greater than about 10 degrees.

15. The cutting bit according to claim 12 wherein the ledge projects laterally outwardly from the tapered surface by a distance greater than 10% of a radius of the tapered surface as measured at an intersection of the ledge with the tapered surface.

16. The cutting bit according to claim 15 wherein the distance is greater than 15% of the radius.

17. The cutting bit according to claim 12 the tapered surface is of concave configuration.

18. The cutting bit according to claim 12 wherein the head is machined to form the ledge, wherein the ledge is of integral one-piece construction with the head.

19. The cutting bit according to claim 12 wherein the ledge is defined by a separate ring mounted on the tapered surface.

20. The cutting bit according to claim 19 wherein the ledge is of generally rectangular cross sectional shape.

21. The cutting bit according to claim 19 wherein the ledge is formed of a harder material than the bit body.

* * * * *